US005213149A

United States Patent [19]

Ruff et al.

[11] Patent Number: 5,213,149

[45] Date of Patent: * May 25, 1993

[54] MOLD AND METHOD FOR MAKING VARIABLE THICKNESS CAST ARTICLES

[75] Inventors: Gary F. Ruff, Farmington Hills, Mich.; John W. Kuhn, Bristol; Richard J. Wylie, Wabash, both of Ind.

[73] Assignee: CMI International, Inc., Southfield, Mich.

[ * ] Notice: The portion of the term of this patent subsequent to Mar. 3, 2009 has been disclaimed.

[21] Appl. No.: 776,607

[22] Filed: Oct. 10, 1991

[51] Int. Cl.[5] ..... B22D 27/04

[52] U.S. Cl. ..... 164/122; 164/124; 164/127; 164/338.1; 164/348; 164/353

[58] Field of Search ..... 164/122, 124, 127, 137, 164/271, 338.1, 348, 352, 353

[56] References Cited

U.S. PATENT DOCUMENTS

| | | | |
|---|---|---|---|
| 1,678,655 | 7/1928 | Sipp | 164/126 |
| 4,674,553 | 6/1987 | Witt | 164/33 |
| 4,742,863 | 5/1988 | Witt | 164/255 |
| 5,072,773 | 12/1991 | Ruff et al. | 164/127 |
| 5,092,390 | 3/1992 | Witt | 164/127 |

FOREIGN PATENT DOCUMENTS

| | | | |
|---|---|---|---|
| 0001540 | 1/1982 | Japan | 164/338.1 |
| 0103775 | 6/1982 | Japan | 164/122 |
| 0118941 | 5/1987 | Japan | 164/122 |
| 0118962 | 5/1987 | Japan | 164/122 |

*Primary Examiner*—Richard K. Seidel
*Assistant Examiner*—Erik R. Puknys
*Attorney, Agent, or Firm*—Reising, Ethington, Barnard, Perry & Milton

[57] ABSTRACT

A permanent metal mold (12) has a casting cavity (18) within which variable thickness molten metal articles (20) are cast. Portions (26) of the casting cavity walls (16) are formed oversized and lined with sand (44) to conform with the external size and shape of certain thick (46) and thin (48) sections of the cast article (20). The thickness of the sand liner (44) is reversely correlated to the thick (46) and thin (48) sections of the article (20) to cause these sections (46, 48) to cool at different rates in order to achieve an approximately equalized cooling time of these sections (46, 48). Other portions (50, 52) of the casting cavity walls (16) are formed bare of the sand liner (44) and conform with the external size and shape of other corresponding sections (54, 56) of the cast article (20). These bare metal portions (50, 52) can either be heated or cooled or both during casting in order to precisely control the cooling rates of these other sections (54, 56) of the cast article (20) and thus precisely control their resultant physical properties.

20 Claims, 1 Drawing Sheet

MOLD AND METHOD FOR MAKING VARIABLE THICKNESS CAST ARTICLES

BACKGROUND OF THE INVENTION

1. Field of the Invention

The present invention generally relates to methods and molds for casting molten metal articles of variable thickness and more specifically to such molds having heating and cooling features for controlling the cooling rate of portions of the cast article within the mold during casting.

2. Description of the Prior Art

When casting metal articles having thick and thin sections, it is desirable to have these sections cool in an equalized manner in order to minimize residual stresses and to produce a more sound casting. However, equalized cooling is difficult to achieve using conventional casting molds and processes since the thin sections of the casting naturally tend to cool at a faster rate than the thicker sections.

A casting mold and process has been recently developed in the United States for achieving such results. The inventor of this mold and process is Raymond H. Witt and the mold and process are disclosed in two related U.S. Pat. Nos., namely 4,742,863 granted May 10, 1988 and 4,674,553 granted Jun. 23, 1987. Witt's contribution to the metal casting art was to provide a permanent metal type mold having an oversized casting cavity lined with a variable thickness sand liner. In order to achieve equalized cooling of the thick and thin sections of the casting, the thickness of the sand liner is varied inversely with the thickness of the casting such that the sand is thicker in sections where the casting is thin and thinner in sections where the casting is thicker. This effectively increases the cooling rates of the thick sections while at the same time decreases the cooling rates of the thinner sections. By adjusting the cooling rates of these sections, their respective cooling times can be equalized. Very high quality, sound castings have been produced this way.

Although the above mold and process has shown to work well for equalizing the cooling times of thick and thin sections of a casting in most all applications, there are still other applications where it is desirable to vary the results achieved by the above mold and process. Specifically, there are some applications in which sections of the casting are very thin and a sand liner (no matter how thick) cannot lower the cooling rate of these sections sufficiently to achieve equalized cooling with the other sections of the casting.

In still other applications, it is desirable to harden the surfaces of certain sections of the casting. Usually, this is achieved through a subsequent heat treating operation following casting. However, surface hardening can also be achieved by rapidly chilling the surface during casting. Solid metal chills are typically employed for this purpose. Examples of such solid metal chills are disclosed in U.S. Pat. Nos. 936,623 to Griffith, granted Oct. 12, 1909; 1,524,391 to Durham, granted Jan. 27, 1925 and 1,876,073 to Player, granted Sep. 6, 1932.

A problem arises, however, when the surface to be hardened is a very thick section of the casting. In this case, conventional solid metal chills are inadequate since they are incapable of extracting heat from the surface of the casting at a fast enough rate to develop the desired hardened properties. This is so even when used with the thick and thin type casting molds.

SUMMARY OF THE INVENTION AND ADVANTAGES

A method for casting molten metal articles of variable thickness in a mold includes forming cavity walls within a permanent metal mold to define a casting cavity. The cavity walls are lined with sand to conform with the size and shape of corresponding sections of the article to be cast within the cavity. Unlined bare metal portions of the cavity walls are formed to conform with the size and shape of other corresponding sections of the article. The thickness of the sand is varied to form thick and thin portions of the sand liner. Molten metal is then cast into the casting cavity. The method is characterized by controlling the temperature of the bare metal portions of the cavity walls during casting, whereby the thick and thin portions of the sand liner are reversely correlated to corresponding thick and thin sections of the resultant cast article such that the sand liner is thicker in sections where the cast article is thin and is thinner in sections where the cast article is thicker to cause the varied thickness sections to cool at different rates with the thinner sections cooling at a relatively slower rate than the thicker sections for producing an approximately equalized cooling time for these sections of the cast article, and the sections of the article contacting the bare metal portions of the cavity walls are caused to cool at a fast rate when the bare metal portions are cooled during casting and are caused to cool at a relatively slower rate when the bare metal sections are heated during casting in order to precisely control the resultant physical properties of these sections of the cast article.

The subject invention also contemplates a casting mold assembly of the type for casting molten metal articles of variable thickness. The mold assembly comprises a permanent metal mold having inner cavity walls defining a casting cavity and a sand liner applied to portions of the cavity walls and conforming with the size and shape of corresponding sections of the article to be cast within the cavity. The sand liner has a variable thickness so as to define thick and thin portions of the liner. The cavity walls include unlined bare metal portions conforming with the size and shape of other corresponding sections of the article to be cast within said cavity. The characterizing feature of the subject mold assembly is temperature control means for controlling the temperature of said bare metal portions of said casting cavity during casting in order to precisely control the cooling rates of the corresponding sections of the cast article in contact with said bare metal portions.

One advantage of the present invention is that the cooling times for thick and thin sections of a casting can be equalized in order to produce a high quality, sound casting while at the same time being able to control the cooling rates of very thick sections of the casting by cooling the bare metal portions of the cavity walls during casting in order to adequately harden the surfaces of these sections.

Another advantage of the subject invention is that the cooling rates of very thin sections of a casting can be controlled by heating the bare metal portions of the cavity walls during casting in order to equalize the cooling time of these sections with the remaining thick and thin sections of the casting.

Still another advantage of the subject invention is that the above features may be combined into a single mold to produce a casting having equally cooled very thin sections and adequately hardened very thick sections.

Still another advantage is that molds having bare metal chill portions that have been cooled during casting can be reused sooner than chills that have not been cooled. Thus, productivity is increased.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

A casting mold assembly constructed in accordance with the present invention is generally shown at 10 in the Figures.

Figure 1:
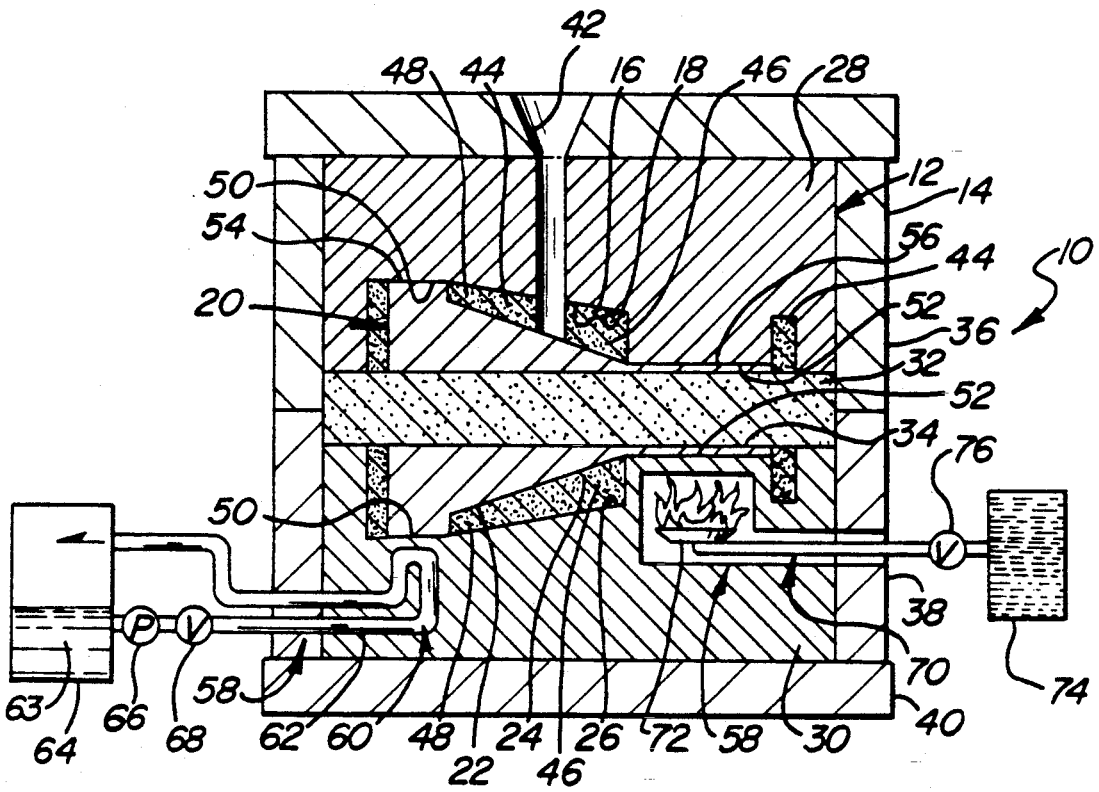
FIG. 1 is a schematic cross-sectional view of a mold constructed in accordance with the present invention.

The mold assembly 10 comprises a permanent mold 12 disposed within a pouring flask 14 and having inner cavity walls 16 defining a casting cavity 18 within the mold 12 within which a variable thickness metal article 20 is cast. Select portions of the cavity walls 16 are oversized with respect to the size and shape of corresponding sections of the article 20 such that they are spaced from the article during casting. The spacing or oversizedness of these portions of the cavity walls 16 is reversely correlated to the varied thickness of the article 20. That is, the walls 16 are more oversized in sections where the article 20 is thin and less oversized in sections where the article 20 is thicker. FIG. 1 illustrates a central tapered section of the cast article 20 showing such thick 22 and thin 24 sections of the article 20. As can be seen, the portion 26 of the cavity wall surrounding the thick 22 and thin 24 sections of the article 20 are oversized and oppositely tapered so that the oversized portion 26 of the cavity walls 16 is spaced further from the thin section 24 of the article 20 than the thicker section 22.

The permanent mold 12 is formed of a permanent or long-lasting material, such as iron, steel or graphite. The mold 12 may be formed with upper 28 and lower 30 mold halves which can be separated for removing the article 20 following casting. A suitable core 32 may also be provided within the casting cavity 18 for reserving the space that occupies in the cavity 18 as a void or a passageway 34 within the resultant cast article 20.

The molding flask 14 may be any suitable commercially available flask that is schematically illustrated to include a cope or upper frame 36 and a drag or lower frame 38 resting on a base or platform 40. With this type of flask 14, the upper mold half 28 is carried within the cope 36, whereas the lower mold half 30 is carried within the drag 38. The flask 14 may also include a suitable cover 42 disposed on the cope 36 and provided with a pouring sprue 42 extending through the mold and into the casting cavity 18 for admitting molten metal into the casting cavity 18. Typically, the sprue 42 will be connected to additional gates or passages (not shown) within the permanent mold 12 for properly distributing the molten metal within the cavity 18. Air vents (not shown) may also be provided for the escape of gases. These features are omitted from the drawings which are intended to be a schematic representation focusing on the subject matter of this invention and will be understood by those skilled in the art as being implied.

A sand liner 44 is applied to the oversized portions 26 of the cavity walls 16 to make up for the gap or space between the oversized cavity walls 26 and the external surface of the corresponding thick and thin sections 22, 24 of the cast article 20. Accordingly, the sand liner 44 has a varied thickness with thick 46 and thin 48 portions which are reversely correlated to the thickness of the article 20, such that the sand liner 44 is thicker in sections were the article 20 is thin 24 and thinner in sections were the article 20 is thicker 22. Thus, as can be seen in FIG. 1, the sand liner 44 is tapered oppositely of the article 20.

The liner 44 may be any suitable commercially available sand material, such as green sand, core sand or mixtures of sand in suitable binders and may be applied to the cavity walls 26 by any suitable method. One method is to blow the sand 44 into the casting cavity 18 between the oversize portion 26 of the cavity walls 16 and a suitable pattern (not shown), as is disclosed in great detail in the U.S. Pat. No. 4,742,863 to Raymond H. Witt, granted May 10, 1988 and incorporated herein by reference.

Once the sand has been packed to form the liner 44, its interior surface corresponds with the size and shape of the exterior surface of the corresponding thick 22 and thin 24 portions of the cast article 20. Thus, the interior surface of the sand liner 44 defines sand casting walls within the casting cavity 18 of the permanent mold for shaping the corresponding sections 22, 24 of the article 20 during casting.

The casting cavity 18 also includes unlined bare portions 50, 52 which conform to the size and shape of other corresponding sections of the cast article 20. That is, the interior surface of selected bare portions 50, 52 of the cavity walls 26 are conformed to the desired outer surface of the corresponding sections of the cast article 20 and are bare of the sand liner 44 for directly contacting and shaping the surfaces of these sections of the article 20 during casting. These bare portions 50, 52 may be formed of the same material as the permanent mold 12 or may be formed from other materials, such as copper/beryllium alloys.

As can be seen in FIG. 1, the bare portions 50, 52 may form very thick 54 and very thin 56 sections of the article 20, which are relatively thicker and thinner than the remaining thick 22 and thin 24 sections of the article 20.

The bare portions 50, 52 are provided with temperature control means 58 for controlling the temperature of the bare portions 50, 52 during casting. By controlling the temperature of the bare portions 50, 52, the heat flow characteristics of these portions 50, 52 can be controlled in order to develop the desired physical properties of the corresponding sections 54, 56 of the article 20 in contact therewith.

For instance, if it is desired to harden the surface of a certain section of an article to be cast within a cavity 18, that portion of the cavity 18 will be formed bare of the sand liner 44 and cooled during casting in order to rapidly extract heat from the surface of the article section to cause it to harden. In other instances, it may be desirable to slow the cooling of an article to be cast within the cavity 18 in order to prevent premature cooling of these sections which can lead to undesired porosity, residual stresses and distortion of the article 20. This is particularly true of very thin sections (e.g., about 2–5 mm thick sections of aluminum articles) which naturally tend to cool faster and thus sooner than thicker sections of the casting. To slow the cooling rate of these very thin sections, the associated bare portions are artificially heated during casting to lessen the rate of heat flow between those sections and their associated bare portions.

Thus, the temperature control means 58 may comprise cooling means or system 60 for cooling the bare portions 50 of the cavity walls 16 in order to increase the cooling rate of the corresponding sections 54 of the article in contact therewith during casting. In the schematic illustration of FIG. 1, the bare portions 50 associated with the very thick sections 54 (e.g., sections greater than ½ inch in aluminum castings) of the article 20 are provided with fluid passages 62 formed therein in which a cooling fluid circulates for cooling these bare portions 50 during casting. The cooling fluid may include water, air or other suitable cooling fluids schematically illustrated to be contained within a reservoir 64 and equipped with a suitable pump or other device 66 for circulating the cooling fluid within the passages 62. The cooling system 60 may also include a valve or other device for metering the flow of cooling fluid through the passages 62 so as to provide more or less cooling to the bare portions 50.

On the other hand, the temperature control means 58 may comprise heating means or system 70 for heating the bare portions 52 of the cavity walls 16 during casting. In the schematic illustration of FIG. 1, the bare portions 52 associated with the very thin sections 56 of the article 20 are heated during casting in order to decrease the cooling and thus decrease the cooling time of these very thin sections 56. The heating system 70 may comprise a gas burner 72 adjacent the bare portions 52 and connected to a suitable source of combustible gas or fuel schematically shown at 72 for burning the gas and directly heating the bare portions 52 during casting. The heating means 70 may also be provided with a suitable valve or other metering device 76 for metering the flow of gas 74 to the burner 72 to control (i.e., increase or decrease) the heating of the bare portions 52.

Although FIG. 1 illustrates the cooling 60 and heating 70 means to be provided in the lower mold half 30 only, it will be appreciated that the upper mold half 28 may also include the cooling 60 and heating 70 means so as to cool or heat the entire bare portions 50, 52.

To cast the article 20 within the mold 12, molten metal is poured into the casting cavity 18 through the sprue 42. As the molten metal is being poured, it is desirable to apply a vacuum within the cavity 18 to enhance the distribution of the molten metal and its speed of cooling. For this purpose, exhaust holes (not shown) may be provided in the permanent mold 12 for communicating with a suitable vacuum source (not shown) in known manner.

After the molten metal is poured, the thick 22 and thin 24 sections of the article 20 will begin to solidify at different rates because of the different insulating effects of the surrounding thick 46 and thin 48 portions of the sand liner 44. Thus, the thicker sections 22 of the article 20 will cool at a faster rate where the liner 44 is thinner 48, while the thinner sections 24 of the article 20 will cool at a slower rate as compared to the thicker sections 22 because of the greater insulation effect of the thicker portions 46 of the liner 24. By correlating the rates of cooling of a thick 22 and thin 24 sections of the article 20, these sections 22, 24 can be timed to arrive at the required removal temperature at about the same time. Moreover, the equalized cooling reduces the internal stresses and resultant internal cracking and porosity normally associated with unbalanced cooling.

The other sections 54, 56 of the article 20 in contact with the bare portions 50, 52 of the cavity wall 16 will also begin to solidify the molten metal is poured into the cavity 18.

With article 20 in FIG. 1, it is desirable to harden the surface of the very thick section 54 of the article 20 in contact with the bare portion 50. In order to achieve the desired hardness, it is necessary to rapidly cool or chill the molten metal contacting the bare portion 50 in order to locally increase the solidification rate of the molten metal contacting the bare portion 50. Since this section 54 is so thick, a solidification rate is needed which cannot be achieved by using just the bare portion 50 of the cavity mold 16 alone. For this reason, these bare portions 50 are cooled with the cooling fluid as the article 20 is solidified in order to enhance the rate of heat transfer between the surface of the very thick section 54 and the surrounding bare portion 50. Thus, by controlling the amount of cooling provided to the bare portion 50, the localized cooling rate of the solidifying metal in contact with the bare portion 50 can be controlled to achieve the desired surface hardness.

After the molten metal is poured, the very thin sections 56 of the article 20 will begin to solidify also. Because these sections 56 are so thin as compared to the remaining sections of the article 20, they have a natural tendency to cool at a relatively fast rate. In the present case, it is desirable to decrease the cooling rate of the very thin sections 56 in order to equalize the cooling time of the very thin sections 56 with the other thick 22 and thin 24 sections of the article 20. The insulating properties offered by the sand liner 44 is insufficient for slowing the cooling rate of these very thin sections 56 sufficiently so as to equalize their cooling time with that of the remaining thick 22 and thin 24 sections of the cast article 20. Thus, these sections 56 would normally cool too quickly and result in casting defects such as porosity, cracking, residual stresses, etc, inherent with such unbalanced cooling.

In order to account for this deficiency, the bare portions 52 of the cavity wall 16 are artificially heated by the heating system 70 as the article 20 is being cast. Heating the bare portions 52 changes the heat flow characteristics of the bare portions 52 such that the rate of heat extraction is reduced. This, in turn, decreases the cooling rate of the very thin sections 56 to the point where they will arrive at the removal temperature at about the same time and as the other thick 22 and thin 24 sections of the article 22 (i.e., balanced cooling).

Figure 2:
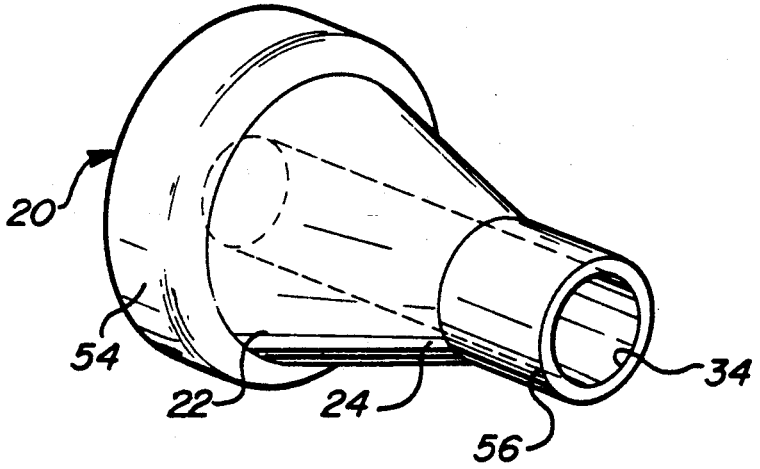
FIG. 2 is a perspective view of an article that has been cast within the mold of FIG. 1.

After the article 20 is cast, the mold halves 28, 30 are separated and the article 20 removed from the cavity 18. The core 32 is then removed to form the completed article 20 as shown in FIG. 2.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A method for casting molten metal articles of variable thickness in a mold, said method comprising the steps of:

forming cavity walls (16) within a permanent mold (12) to define a casting cavity (18);

lining portions (26) of the cavity walls (16) with sand (44) to conform with the size and shape of corresponding sections (22, 24) of the article (20) to be cast within the cavity (18);

forming unlined bare portions (50, 52) of the cavity walls (16) to conform with the size and shape of other corresponding sections (54, 56) of the article (20);

varying the thickness of the sand (44) to form thick (46) and thin (44) portions of the sand liner (44) which are reversely correlated to corresponding thin (24) and thick (22) sections of the resultant cast article (20) such that the sand liner (44) is thicker in sections where the cast article (20) is thin and is thinner in sections where the cast article (20) is thicker;

casting molten metal into the casting cavity (18) causing the varied thickness sections (22, 24) to cool at different rates with the thinner sections (24) cooling at a relatively slower rate than the thicker sections (22) for producing an approximately equalized cooling time for these sections (22, 24) of the cast article (20);

and characterized by controlling the temperature of the bore portions (50, 52) of the cavity walls (16) during casting for precisely controlling the cooling rates and resultant physical properties of the sections (54, 56) of the cast article (20) in contact with the bare portions (50, 52).

2. A method as set forth in claim 1 further characterized by cooling at least some of the bare portions (50) of the cavity walls (16) during casting to produce localized hardened surfaces of the corresponding sections (54) of the cast article (20) in contact therewith.

3. A method as set forth in claim 2 further characterized by providing fluid passages (62) within the bare portions (50) of the cavity walls (16).

4. A method as set forth in claim 3 further characterized by circulating a cooling fluid (63) through the fluid passages (62) in order to cool the bare portions (50) during casting.

5. A method as set forth in claim 4 further characterized by circulating water (63) through the fluid passages (62) as the cooling fluid (63).

6. A method as set forth in claim 4 further characterized by circulating air (63) through the fluid passages (62) as the cooling fluid (63).

7. A method as set forth in claim 2 further characterized by forming the bare portions (50, 52) from a copper beryllium alloy.

8. A method as set forth in either of claims 1 or 2 further characterized by heating at least some of the bare portions (52) of the casting cavity (18) during casting to decrease the cooling rate of the corresponding sections (56) of the cast article (20) in contact therewith.

9. A method as set forth in claim 8 further characterized by heating the bare portions (52) of the casting cavity (18) with heat generated by a combustible gas burner (72).

10. A casting mold assembly of the type for casting molten metal articles of variable thickness, said assembly comprising:

a permanent mold (12) having inner cavity walls (16) defining a casting cavity (18);

a sand liner (44) applied to portions (26) of the cavity walls (16) and conforming with the size and shape of corresponding sections (54, 56) of the article (20) to be cast within the cavity (18), said liner (44) having a variable thickness so as to define thick (46) and thin (48) portions of said sand liner (44);

unlined bare portions (54, 52) of said cavity walls (16) conforming with the size and shape of other corresponding sections (54, 56) of the article (20) to be cast within said cavity (18);

characterized by temperature control means (58) for controlling the temperature of said bare portions (50, 52) during casting in order to precisely control the cooling rates of the corresponding sections (54, 56) of the cast article (20) in contact with said bare portions (50, 52).

11. A mold assembly as set forth in claim 10 further characterized by said temperature control means (58) comprising cooling means (60) for cooling at least some of said bare portions (50) during casting to produce localized hardened surfaces on the sections (54) of the article (20) in contact therewith.

12. A mold assembly as set forth in claim 11 further characterized by said bare portions (50) including fluid passages (62) therein.

13. A mold assembly as set forth in claim 12 further characterized by said cooling means (60) comprising a cooling fluid (63) within said fluid passages.

14. A mold assembly as set forth in claim 13 further characterized by said cooling fluid (63) comprising water.

15. A mold assembly as set forth in claim 13 further characterized by said cooling fluid (63) comprising air.

16. A mold assembly as set forth in claim 10 further characterized by said bare portions (50, 52) being formed of metal.

17. A mold assembly as set forth in claim 16 further characterized by said bare portions (50, 52) being formed of a copper/beryllium alloy material.

18. A mold assembly as set forth in either of claims 10 or 11 further characterized by said temperature control means (58) comprising heating means (70) for heating at least some of said bare portions (52) to decrease the cooling rates of the corresponding sections (56) of the article (20) in contact therewith.

19. A mold assembly as set forth in claim 18 further characterized by said heating means (70) comprising a combustible gas burner (72) directly heating said bare portions 56.

20. A casting mold assembly of the type for casting molten metal articles of varied thickness, said mold assembly comprising:

a permanent mold (12) having inner cavity walls (16) defining a casting cavity (18) within said mold (12);

a metal article (20) cast within said casting cavity (18), said article (20) having a varied thickness defining thick (22) and thin (24) sections of said article (20) of a predetermined external size and shape;

a sand liner (44) applied to portions (26) of said cavity walls (16) and conforming with the external size and shape of corresponding said thick (22) and thin (24) sections of said article (20), said liner (44) having a varied thickness reversely correlated to the thickness of said corresponding sections (22, 24) of said article (20) such that said liner (44) is thicker in sections where said article (20) is thin and thinner in sections where said article (20) is thicker to cause said varied thickness sections (24) of said article to cool at different rates with said thinner sections (24) cooling at a relatively slower rate than said thicker sections 22) for producing an approximately equalized cooling time for these sections (22, 24);

unlined bare portions (50, 52) of said cavity walls (16) conforming with the external size and shape of other corresponding sections (54, 56) of said article (20) for directly contacting these sections (54, 56) during casting;

and characterized by temperature control means (58) associated with said bare portions (50, 52) for controlling the temperature of said bare portions (50, 52) during casting in order to control the cooling rates and resultant physical properties of said other sections (54, 56) of said article (20) in contact therewith.

* * * * *